United States Patent [19]

Wolf et al.

[11] Patent Number: 4,530,740

[45] Date of Patent: Jul. 23, 1985

[54] METHOD OF PRODUCING CLOSED CANALS IN COMPONENTS SUCH AS HEAT EXCHANGERS AND ROCKET COMBUSTION CHAMBER WALLS

[75] Inventors: Dietmar Wolf, Siegertsbrunn; Otto Tuscher, Oberschleissheim, both of Fed. Rep. of Germany

[73] Assignee: Messerschmitt-Bölkow-Blohm GmbH, Fed. Rep. of Germany

[21] Appl. No.: 604,838

[22] Filed: Apr. 27, 1984

[30] Foreign Application Priority Data

Apr. 28, 1983 [DE] Fed. Rep. of Germany ..... 3315407

[51] Int. Cl.[3] ..... C25D 1/02

[52] U.S. Cl. ..... 204/9

[58] Field of Search ..... 204/9

[56] References Cited

U.S. PATENT DOCUMENTS 3,329,588 7/1967 Mears ..... 204/9

3,692,637 9/1972 Dederra ..... 204/9

4,326,928 4/1982 Dugan ..... 204/9

*Primary Examiner*—Thomas Tufariello

*Attorney, Agent, or Firm*—McGlew and Tuttle

[57] ABSTRACT

A method of closing a canal which has been formed in a wall of a component such as a heat exchanger for rocket combustion chamber walls comprises inserting an elongated filler into the canal so as to leave at least one end of the filler which projects out of the canal, filling the remaining space with an electrically conducting melting substance such as a wax, engaging the projecting end of the filler to pull it out of the substance in the canal and to leave the expanding chamber in the substance, an electroplating metalloplastic material onto the component to form a cover over the canal and the substance therein. Electroplating can be carried out without causing any heat which is produced thereby to affect an expansion in the canal which would disturb the electroplating or the formation of the component.

6 Claims, 8 Drawing Figures

METHOD OF PRODUCING CLOSED CANALS IN COMPONENTS SUCH AS HEAT EXCHANGERS AND ROCKET COMBUSTION CHAMBER WALLS

FIELD AND BACKGROUND OF THE INVENTION

This invention relates in general to rocket combustion chambers and in particular to a new and useful method of closing canals or cavities which are formed in the walls of combustion chambers or heat exchangers or similar components.

The invention relates in particular to a method to produce closed canals or other cavities provided in components such as heat exchangers or rocket combustion chambers, which canals or cavities are closed towards the outside by a metalloplastic cover in such a manner that after the insertion of elongated fillers of considerably smaller section than the canal or cavity section they are filled with a substance, in particular wax, which can be melted out and either is electrically conducting due to additives or is coated by an electrically conducting layer, whereupon the cover is galvanized on.

It is known from German PS No. 28 15 525 to close the longitudinal cooling canals worked into the base structure of a component such as a rocket combustion chamber with a galvanically produced cover layer. Toward this end, tubular fillers are inserted into the cooling canals before this cover layer is galvanized on, the filler section being considerably smaller than the cooling canal section. The remaining space is filled by an electrically conducting wax, whereupon the cover layer is galvanized on. Then the tubular fillers are flushed out or removed by a chemical solvent conducted through them. This creates cavities in the wax which perform the function of absorbing the wax expansions occurring due to heating during the subsequent wax melting operation, so that the wall structure remains unaffected by compressive forces, which means that the cover layer and its sensitive connections to the canal webs are not subjected to the expansion forces of the wax.

However, besides this noteworthyadvantage the known method has the disadvantage that the chemical removal of the numerous tubes located in the wax and serving as fillers is cumbersome, time-consuming and expensive.

SUMMARY OF THE INVENTION

The invention provides a method of forming closed canals which is not only capable of compensating expansions of the wax which is heated for the purpose of melting it out, but is also suited to effect substantial production simplifications along with being economically cheaper.

According to the invention, the elongated fillers project out of the canals or cavities with at least one of their ends, by means of which they can be pulled out of the canals or cavities which is filled with the substance later to be melted out, in particular wax before a cover layer is galvanized on, the openings of the expansion chambers thus created are closed with meltable stoppers, especially wax stoppers, whereupon the cover layer is galvanized on and the above mentioned substance or wax subsequently melted out.

In order to facilitate pulling out the fillers and not damage or deform the canal fillings when pulling out the fillers it is suggested furthermore to remove the fillers at a temperature of the substance later to be melted out which is higher than room temperature and causes this substance to become slightly plastic, e.g. at a wax temperature between 30° and 50° C.

In a further development of the invention, it is suggested to use plastic strings or metal wires, such as aluminum wires, as fillers.

In addition to the requirement of creating in simple manner spaces for the expansion of the wax which must be heated to melt it out, a technologically economical method is suggested by the invention, by means of which labor and material costs are saved.

Accordingly it is an object of the invention to provide an improved method for closing canals which are formed in walls of components such as heat exchanger rocket combustion engines, etc. includes placing an elongated filler into the canal and applying a multiple substance over it and withdrawing the filler so as to leave an expansion chamber to absorb any heat expansion which is effected as a metallic cover is formed over the canal.

DESCRIPTION OF THE PREFERRED EMBODIMENTS

Figure 1:
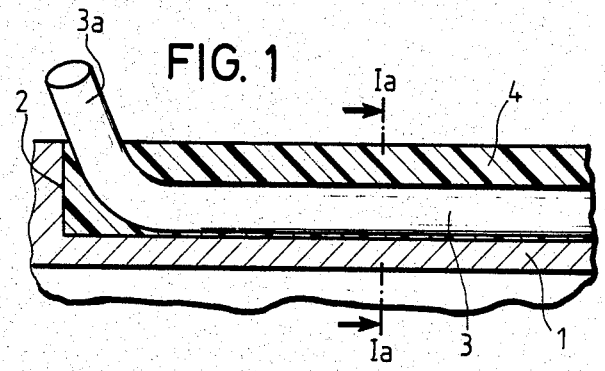
FIG. 1 is a partial sectional view of a rocket engine combustion chamber having a canal which is closed by a method of the invention.
Figure 1A:
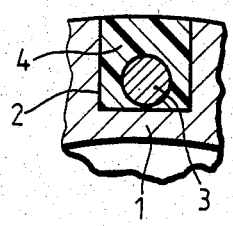
FIG. 1*a* is a section taken along the line Ia—Ia of FIG. 1.

Referring to the drawings in particular the invention embodied therein comprises a method of closing a canal 2 in a component such as rocket engine combustion chamber or heat exchanger walls 1 which comprises inserting an elongated non-hollow or solid filler 3 into the canal 2 leaving at least one end 3*a* which projects out of the canal. Thereafter the canal space is filled with an electrically conducting meltable substance such as a wax 4 which is an electrically conducting wax. The filler 3 is then pulled out by engaging the projecting end 3*a* and pulling so as to leave an expansion chamber 5 which is covered by a wax stopper 6.

Figure 3:
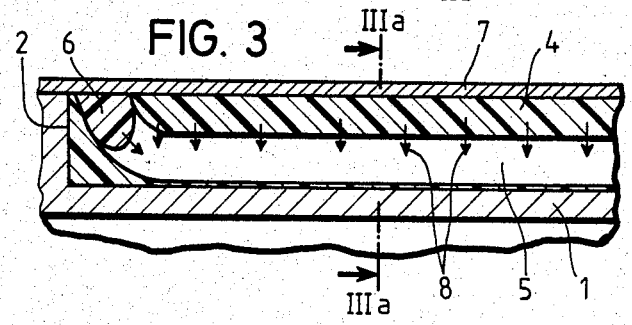
FIG. 3 is a section similar to FIG. 2 indicating the electroplating of a cover onto the canal.

As shown in FIG. 3, a cover 7 is electroplated over the conducting wax 4 and onto the component 1 and the melting out of the wax takes effect by the expansion of the material in the direction of the arrows 8 as shown in FIG. 3. In the inventive layer because of the expansion chamber 5 which is formed by the removal of the filler 3 does not cause any damage to any of the component parts.

One embodiment of the invention is shown in the drawings. FIGS. 1 through 4 depict the various steps of the method to produce a closed canal in a component such as a combustion chamber wall 1.

Figure 2:
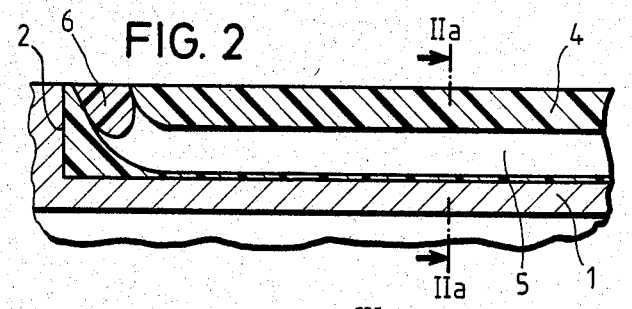
FIG. 2 is view similar to FIG. 1 with the filler withdrawn from the canal.
Figure 2A:
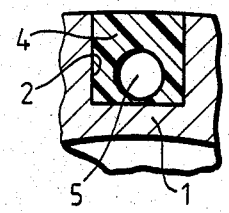
FIG. 2*a* is a section along the line IIa—IIa of FIG. 2.

In the component 1 a recess in the form of a canal 2 is provided, in which an elongated filler 3 in the form of a metal wire or a plastic string is inserted. The rest of the volume of the canal 2 is filled with a readily melting filler, in particular an electrically conducting wax 4. After solidification of the wax 4, i.e. at a temperature slightly above room temperature, roughly between 30° and 50° C., the filler 3 is pulled out at its end projecting out of the wax layer so that an unoccupied expansion chamber 5 is created within the wax 4, as shown in FIGS. 2 and 2*a*. This chamber 5 is closed towards the outside by a readily meltable stopper 6, in particular one of the same consistency as the wax 4. The stopper 6 is preferably of the same material as the filler matieral, i.e. also wax.

Figure 3A:
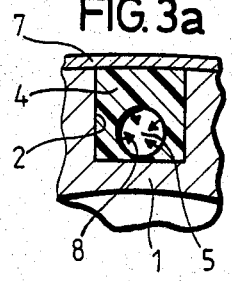
FIG. 3*a* is a section taken along the line IIIa—IIIa of FIG. 3.

After the insertion of the various stoppers 6 a cover layer 7 is applied in an electroplating bath to the electrically conducting surface of the component 1, as shown in FIGS. 3 and 3*a*.

These figures also show the melting out process in its initial stage, the wax 4 starting to expand due to being heated (expansion arrows 8), which can occur without damage to the structure or the component 1 with the cover layer 7 on account of the expansion chambers 5.

Figure 4:
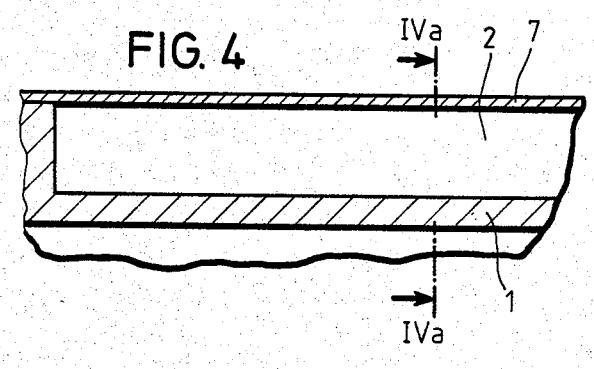
FIG. 4 is a section similar to FIG. 3 showing a completed and covered canal.
Figure 4A:
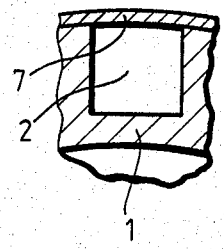
FIG. 4*a* is a section taken along the line IVa—IVa of FIG. 4.

FIGS. 4 and 4*a* show the finished component 1, 7 with the canals 2 closed by the covers 7, the wax already melted out of the canals.

While a specific embodiment of the invention has been shown and described in detail to illustrate the application of the principles of the invention, it will be understood that the invention may be embodied otherwise without departing from such principles.

What is claimed is:

1. A method of closing a canal in a wall of a chamber, comprising inserting an enlongated filler into the canal leaving at least one end of the filler which projects out of the canal, filling a remaining space of the canal with an electrically conducting meltable substance, engaging the projecting end of the filler, pulling the engaged projecting end of the filler out of the substance in the canal leaving an expansion chamber with a hole therein extending to a surface of the substance in the canal, the filler being pulled out of the substance when the substance is at a temperature which is above room temperature so that the substance becomes slightly plastic, plugging the hole to form a continuous surface for the substance in the canal, electroplating metal plastic material to the component to form a cover over the canal and over the continuous surface of the substance in the canal, whereby heat produced during the electroplating causes expansion of the substance into the expansion chamber, and subsequently melting the meltable substance out of the canal.

2. A method according to claim 1, including inserting a solid non-hollow elongated filler into the canal.

3. A method according to claim 2, wherein the filler comprises a plastic string.

4. A method according to claim 2, wherein the filler comprises a metal wire.

5. A method according to claim 4, wherein the filler comprises a smooth surfaced aluminum wire.

6. A method according to claim 2, wherein the substance is wax, the hole is plugged with wax, and the filler is pulled from the substance when the substance is at a temperature of about 30° to to 50° C.

* * * * *